United States Patent [19]

Bachler

[11] Patent Number: 4,788,783

[45] Date of Patent: Dec. 6, 1988

[54] SKI-TRACK FORMING APPARATUS

[76] Inventor: Anton R. Bachler, Seestrasse 49, Hergiswil, Switzerland

[21] Appl. No.: 29,734

[22] Filed: Mar. 24, 1987

[51] Int. Cl.[4] ..... E01C 19/22

[52] U.S. Cl. ..... 37/220; 172/393

[58] Field of Search ..... 37/219–224; 172/392–393

[56] References Cited

U.S. PATENT DOCUMENTS

| | | | |
|---|---|---|---|
| 3,656,557 | 4/1972 | Eskelson et al. | 37/219 |
| 4,523,398 | 6/1985 | Scheibel et al. | 37/220 |
| 4,559,725 | 12/1985 | Wieland et al. | 37/222 |

FOREIGN PATENT DOCUMENTS

| | | | |
|---|---|---|---|
| 1031563 | 5/1978 | Canada | 37/219 |

*Primary Examiner*—Eugene H. Eickholt

*Attorney, Agent, or Firm*—Tarolli, Sundheim & Covell

[57] ABSTRACT

The present invention relates to a ski-track forming apparatus with a track-forming unit (1) having two parallel track-forming tools (2), extending in the track direction. In order to form a ski-track, when a ski course is formed, along the ideal line of the course in one operation, the track-forming unit (1) is fastened to the end of an arm (3) the other end of which is supported for horizontal and transverse movement relative to the track direction on a guide rod support means (4) which can be mounted on a vehicle (VD), which is preferably a track-laying levelling caterpillar vehicle.

20 Claims, 4 Drawing Sheets

SKI-TRACK FORMING APPARATUS

The present invention relates to a ski-track forming apparatus with a track-forming unit having two parallel track-forming tools extending in the track direction.

A track-forming apparatus of this kind is known from German Disclosure No. 25 33 831. In this known device, the track-forming unit consists of a track sledge which is pulled by a traction vehicle, for example, a motor sledge. The "caterpillars" of the traction vehicle and also additional rollers or the like level a course for skiing at least of a stock width. The track sledge pulled behind form, in the middle of the levelled course, the desired pair of track grooves. Also known are double devices for simultaneous laying of two tracks, side by side, along a correspondingly wider course.

According to a new rule of competition, adapted at a Rule conference of the FIS at the beginning of June, 1986 in Garmisch-Partenkirchen, in the so-called classic long-run discipline, in future, only a single track, along an ideal line of a levelled course of a width of about three meters, should be laid.

The known ski-track forming apparatus pulled by a vehicle cannot do this, at least in a single working step.

The object of the present invention is a ski-track forming apparatus for laying a track along the ideal line of a levelled course of a width of about three meters, in a single working step.

This and other objects are achieved according to the present invention, by providing a new ski-track forming apparatus with the features of claim 1.

The invention provides, accordingly, a ski-track forming apparatus with a track-forming unit with track-forming tools extending in the track direction, the track-forming tools unit being fastened to an end of an arm of which the other end is supported by guide rod support means mounted on a vehicle and movable in a horizontal direction and a transverse direction with respect to the track direction.

Advantageous embodiments of the invention are recited in the subclaims.

Especially important here are two universal joints the axis of which has a vertical component. These universal joints facilitate the movement of the arm and the track-forming unit fastened thereto, transverse to the track direction, since the track-forming unit can have, in the track direction, a considerable inertia. Moreover, these two universal joints provide for forming the track without sharp bends and prevent a deviation of the track from the ideal line.

Other universal joints permit different height adjustment of the arm with the track-forming unit. In this way, it can be adapted to the form of the course and, for example, brought into an advantageous carrying position.

Other features, embodiments and advantages of the present invention will become apparent from the following description of an example of preferred embodiment with reference to the attached drawings.

In the Drawings.

In the Figures, corresponding elements have corresponding reference numbers.

With reference to the drawings, the apparatus according to the preferred embodiment of the invention comprises a track-forming unit 1 the underside of which carries a pair of track-forming tools 2. The track-forming tools 2 are elongated skids extending in the track direction.

The track-forming unit 1 is fastened to one end of an arm 3 the opposite end of which is supported for horizontal and transverse movement with respect to the track direction by a guide rod support means 4. The guide rod support means 4 is mounted on the rear part of a caterpillar track-laying vehicle VD of a preferably, so-called, Pistenbully type designed for preparation of ski runs.

Figure 4:
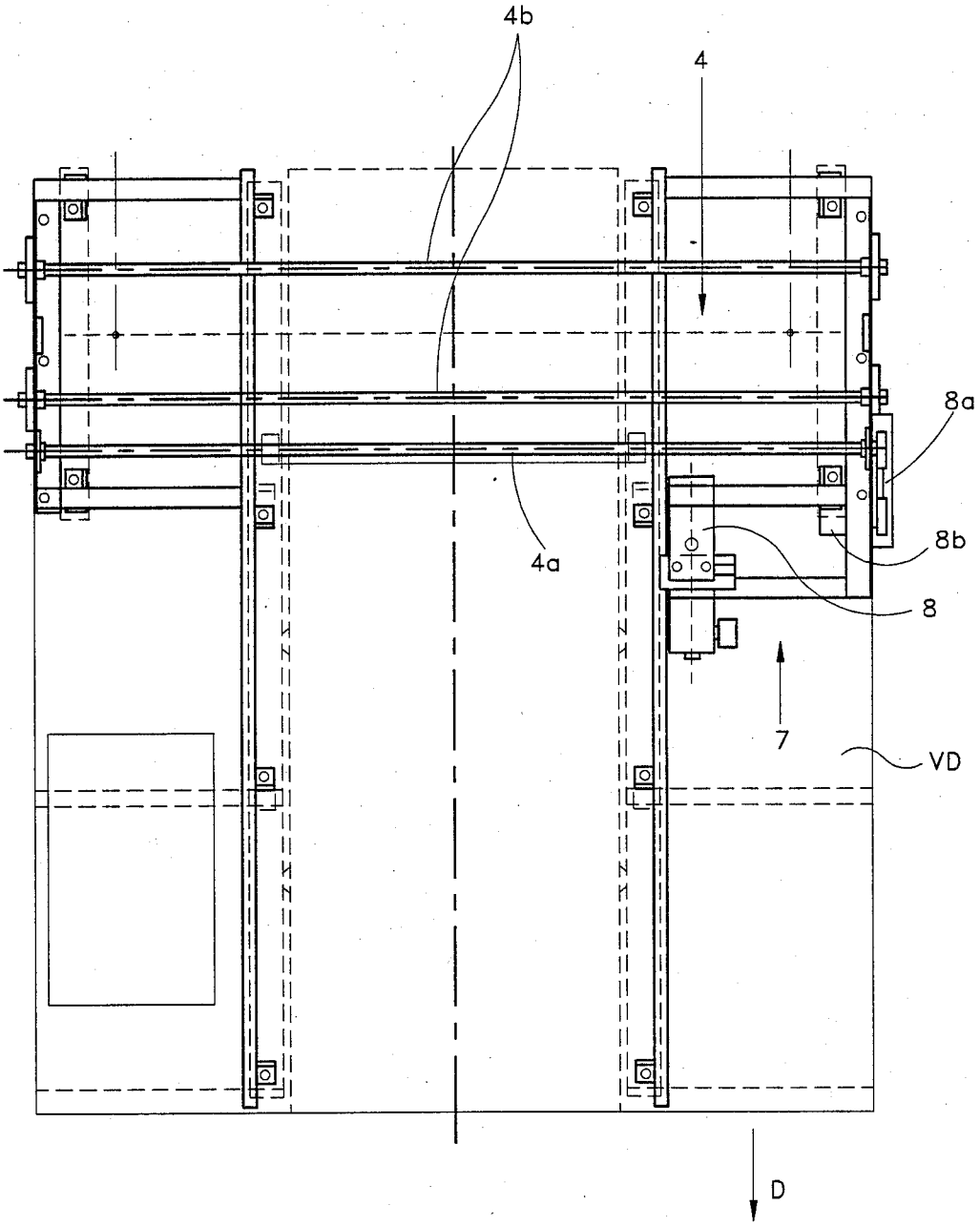
FIG. 4 shows a plan view of the rear part of the above-mentioned caterpillar track-laying vehicle with details of a guide rod support, unit mounted thereon.

As can be seen in FIG. 4, the guide rod support means 4 has two guide rods **4*b*, extending parallel and transverse to the driving direction D (or the longitudinal extent of the vehicle VD). A threaded spindle 4*a*, driven through a tooth-belt gear 8*a* by an electric motor 8*b* is arranged parallel to the guide rods 4*b***. These elements are held or supported in a frame mounted on the caterpillar track-laying vehicle VD.

The arm 3 is divided by several universal joints into essentially three sections: a first end section F connected with the guide rod support means 4 and extending in the driving direction D, an intermediate section C, and a second rear end section R, connected with the track-forming unit 1.

The front end section F of the arm 3 is simply a standing upright post the base of which is supported on the guide rods **4*b* of the guide rod support means 4 and is movable along the rods. The base is also provided with a nut (threaded hole) for receiving the threaded spindle 4*a***.

By rotating the threaded spindle **4*a* by the motor drive means 8*a*, *b*, the arm 3** is movable linearly in the direction of the arrow T between positions VIII and IX.

The intermediate section C of the arm 3 is connected pivotably around a vertical axis XI to the front end section F. This pivotal connection defines first universal joint 5. The rear section of the, arm 3 with the track-forming unit 1 can, therefore, pivot in a horizontal plane. This freedom of movement of the section of the arm 3 is possible due to operation of two return spring elements 9, but only between annular positions V and VI whereby the return spring element keep the sections of the arm 3 in a preferred position in the driving direction D. The positions V and VI form an angle of about 30° with this preferred position. The return spring elements 9 are, for example, gas springs. Preferably, they are so arranged, constructively, that their spring effect is completely realized only when the arm 3 is in a carrying position, still to be described, but in an operating position the spring action is still relatively weak.

The arm 3 is provided with another second universal joint 11 the axis X6 of which has, at least during the track-forming operation, a vertical component. This second universal joint 11 is located in the transition zone from the intermediate section C of the arm 3 to its rear end section R, and at a distance from the track-forming unit 1 by about one-third of the total length of the arm 3. Return spring forces act on this second universal joint 11 to bias it to a preferred position. In the preferred position, the arm 3, in the zone of the joint, is not bent and is already extended. The return spring forces acting on this second universal joint 11 are considerably greater than those of the return spring element 9 of the first universal joint 5, at least when the arm 3 is brought into an operating position for forming of the track. The freedom of rotation of the rear end section R of the arm 33 with the track-forming unit 1 in relation to the intermediate part C of the arm 3, is limited by stops which are preferably adjustable. It should preferably be able to pivot to at least 20° to each side of the preferred position.

To be able to take into account both the natural form of the ground and snow conditions, and also to be able to lift the track-forming unit 1 from the track and bring it into an advantageous carrying position, there are also provided in the arm 3 universal joints having horizontal and extending transverse to its longitudinal direction axes as, for example, in the arm of an excavator.

Of these universal joints, a first joint 6 with an axis X2 is arranged near the first universal joint 5, that is, between the front end section F of the arm 3 and its intermediate section C. A second universal joint 13, with an axis X5, is arranged near the second universal joint 11. It connects the intermediate section C of the arm 3 with its rear end section R. Finally, two more such universal joints 16 and 17, with axes X3 and X7, are arranged near the track-forming unit 1, or directly on the latter.

The universal joints 6, 11 and 17 may be operated hydraulically, by means of hydraulic cylinders 12, 13*a* and 8, which are connected, through corresponding pressure lines, with an electro-hydraulic drive assembly 7 with a compressor 8. The cylinder 12 acts as a lifting and pressing cylinder. It lifts the arm 3 and the track-forming unit 1 between the positions II and III by about 2 meters above the track level, and lowers them by about 1 meter below this level, and especially pressed into the course.

Figure 2:
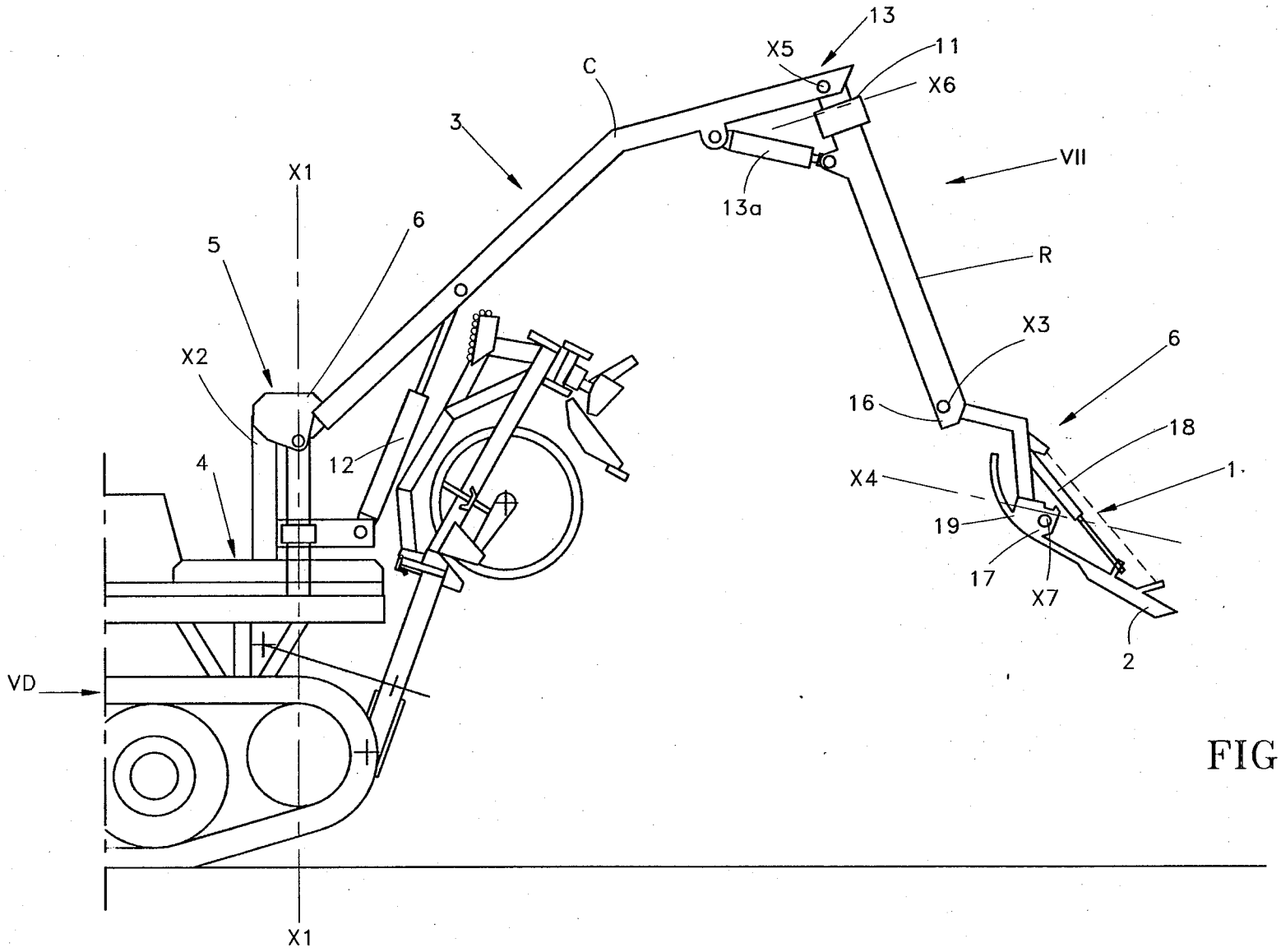
FIG. 2 shows a side elevation view of a track-forming apparatus according to FIG. 1 in a transport position VII.
Figure 3:
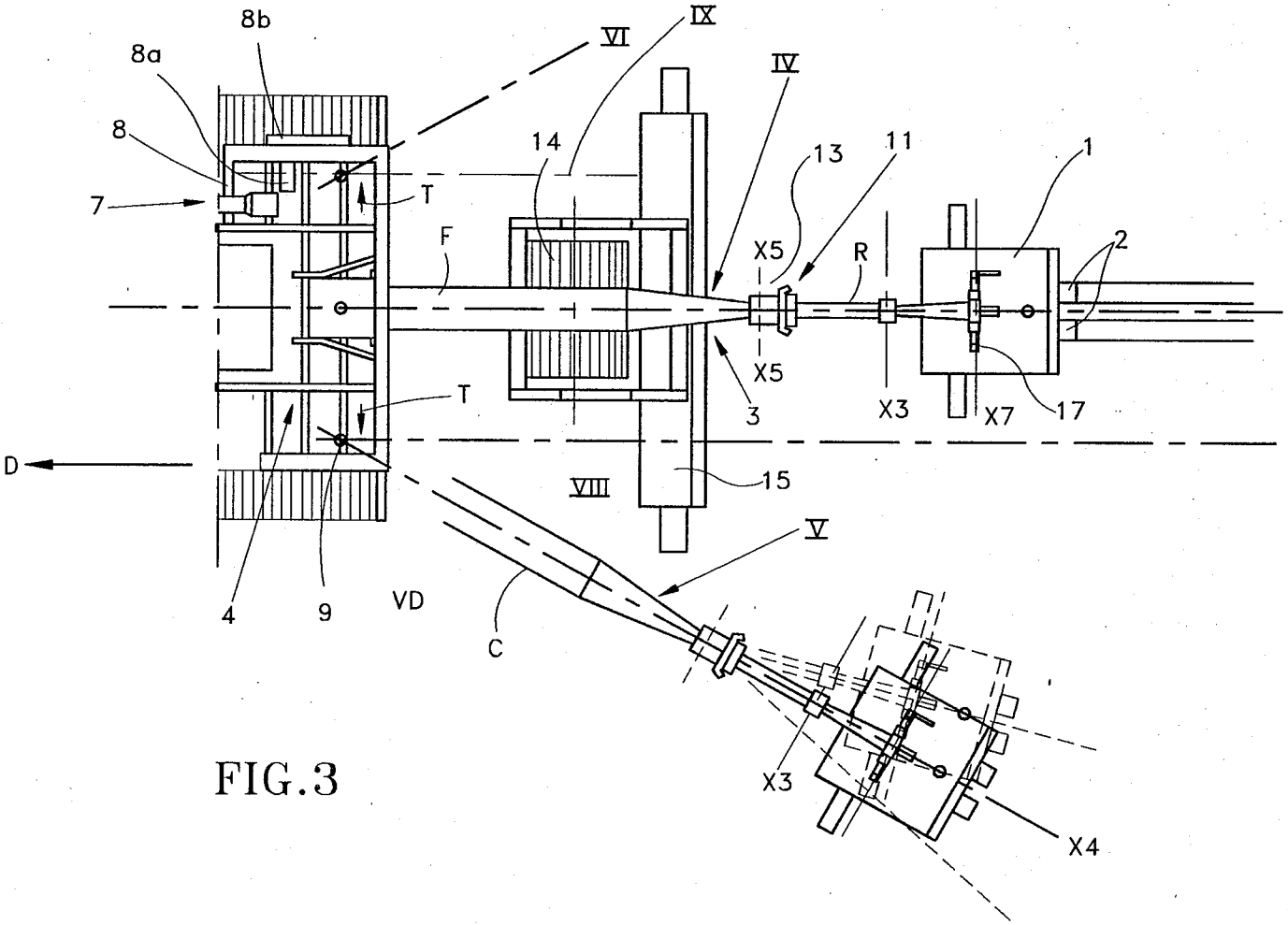
FIG. 3 shows a top view of a track-forming apparatus according to FIGS. 1 and 2 in a straight-forward driving position IV, and in a curved-driving position V; and, finally.

The cylinder 13*a* acts as a "catch" or locking cylinder. By operating this cylinder, the arm 3 and the track-forming unit 1 can be brought into a raised position, at a relatively great angle, and thus into an advantageous carrying position VII, as shown in FIG. 2. In this carrying position, the arm 3 is held quite rigidly by the return spring element 9 in an extended or driving direction.

The cylinder 18, advantageously, sets the attack angle of the track-forming unit 1 in relation to the track.

The universal joint 16 can be fixed in a desired position by suitable fastening means.

Finally, still another universal joint, not yet mentioned, is provided in the arm 3, namely, the joint 19. This, like the universal joint 17, is located almost directly against the track-forming unit 1. Its axis X4 which, at least while the track-forming unit extends in the track direction, extends substantially lengthwise of the arm 3. Through this universal joint 19, the track-forming unit 1 can be tilted to the side and, thus, adapted to a lateral shifting of the course.

Figure 1:
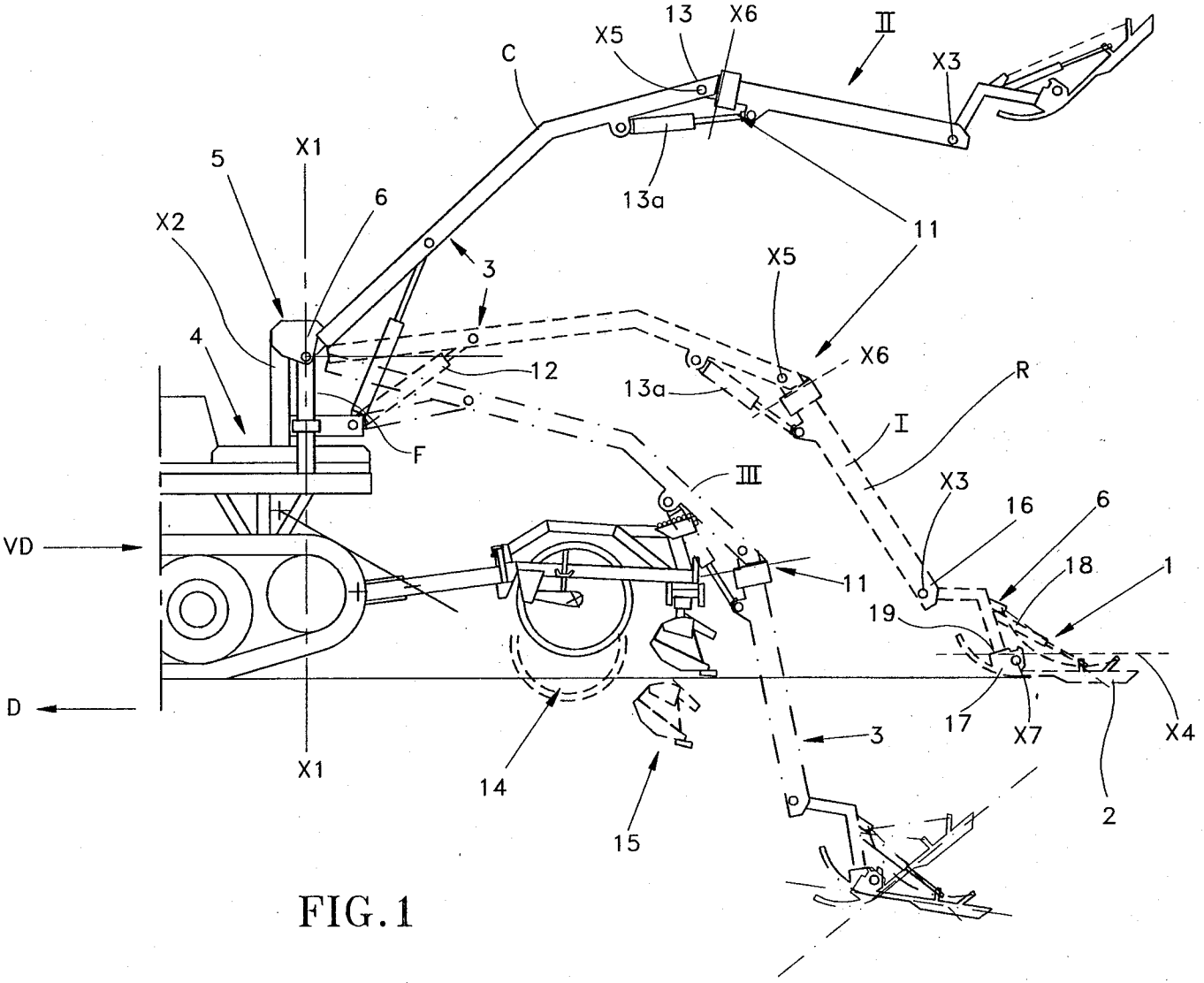
FIG. 1 shows side elevation view of a track-forming apparatus according to the invention mounted on the rear part of a caterpillar track-laying vehicle, shown only in part, in a normal working position I (in heavy black line), in an extreme lifted position II, and an extreme lowered position III.

As shown in FIGS. 1 and 2, elements 14 and 15 are also mounted on the rear portion of the track-laying vehicle VD; the element 14 is a smoothing roller, and the element 15 is a cutting device. They supplement the action of the caterpillars of the caterpillar track-laying vehicle VD and effect levelling and preparation of the ski-track course and must be actuated before the track-forming unit 1 when laying the ski-track. The length of the arm 3 is chosen such that it can accommodate all the above-mentioned joints. The length of the arm 3 is, therefore, between 3 and 5 meters.

The above-described ski-track apparatus permits, when, as shown in the figures, it is mounted on the rear portion of a Pistenbully, to effect in the same work step when levelling the course with a caterpillar vehicle, practically any desired profile of the track within the course, especially, extending along the ideal line of the course.

The position of the track within the course may be varied by moving the arm 3 on the guide rod support means 4, by means of the motor drive means 4*a*, 8*a*, 8*b*. This may be done, for example, by a person riding on the caterpillar track-laying vehicle.

The track-forming unit 1 has, however, a considerable inertia, in its particular position and direction already taken, which makes difficult the changing of its position within the course. This problem occurs especially in sharp curves.

But the two universal joints 5 and 11 greatly facilitate a change of position of these joints to permit the track-forming unit 1 not to follow, directly and to the same degree, the changed position of the arm 3 on the guide rod support means 4. Rather, at first, as can easily be seen, a pivotal movement of the rear section of the arm 3 around the axis XI of the universal joint 5 out of the driving direction D, is effected, during which the original position of the track-forming unit 1 within the course is at first retained. Then, an opposite rotation around the axis X6 of the second universal joint 11 is effected. This prevents an abrupt change of the direction of the track-forming unit 1 and, thus, damaging of the course. The return spring forces of the universal joints 5 and 11 must, naturally, be chosen so that they do not obstruct these rotations. Only as a result of the subsequent forward movement of the track-laying vehicle VD, is the track-forming unit 1 finally, swung in, along an approximately S-shaped path continuously to a new position within the course in which the arm again extends in the driving direction D, and the universal joints 5 and 11 are in their preferred positions. The return spring forces of the universal joints 5 and 11 assist in this swinging in.

The two universal joints 5 and 11 permit to solve advantageously still another problem. As explained, the ski-track apparatus according to the invention is preferably used in connection with a caterpillar track-laying vehicle, and is mounted on the rear portion of the latter.

The rear portion of a caterpillar vehicle, however, has a considerable lateral swing-out when it changes its driving direction, and namely, opposite the change of the driving direction. Therefore, if the two universal joints 5 and 11 were not provided, the track, in curves of the course, would automatically be deflected toward the outer curve. But, as we know, the ideal line in a curve runs precisely along its more strongly curved inner side. The two universal joints 5 and 11, however, prevent this undesirable deflection of track and, due to an additional possibility of movement along the threaded spindle, a continuous forming of the track along the ideal line of the course is possible.

I claim:

1. A ski-track forming apparatus, with a track-forming unit having two parallel track-forming tools extending in the track direction, with the distinction that the track-forming unit (1) is fastened to the end of an arm (3) the other end of which is supported for horizontal and transverse movement relative to the track direction on a guide rod support means (4), which can be mounted on a vehicle (VD), especially a caterpiller track-laying vehicle suitable for levelling of ski courses.

2. A track-forming apparatus according to claim 1, with the distinction that the arm (3) is provided, in the zone of its end supported on the guide rod support means (4) with a universal joint (5) with a substantially vertical axis (X1).

3. A ski-track forming apparatus according to claim 2, with the distinction that the arm (3), preferably at a distance from the track-forming unit (1) which corresponds to about one-third of its total length, is provided with a second universal joint (11) with an axis (X6) having a vertical component, at least during track forming, for connecting an end portion of the arm to which the track forming unit is fastened, to the remaining portion of the arm for pivotal movement of said end portion about said vertical component of the axis (X6) of said second universal joint.

4. A ski-track forming apparatus according to claim 3, with the distinction that the universal joints (5, 11) have in each case a preferred position in which the arm (3) extends in the track direction or relative thereto.

5. A ski-track forming apparatus according to claim 1, with the distinction that the guide rod support means (4) comprises two guide rods (4*b*) parallel to each other and extending horizontally and transverse to the track direction, and which support for movement therealong an end section (F) of the arm (3), designed as an upright post, and movable by means of a motor drive element (8*a*, 8*b*) as well as a threaded spindle (4*a*).

6. A ski-track forming apparatus according to claim 3, with the distinction that the arm (3) is provided with three hydraulically operable universal joints (6, 13, 17), with axes (X2, X5, X7), in each case, extending in horizontal and transverse direction relative to its longitudinal direction.

7. A ski-track forming apparatus according to claim 6, with the distinction that one (6) of the universal joints (6, 13, 17), with axes (X2, X5, X7) extending in horizontal and transverse directions relative to the longitudinal direction of the arm (3), is located near the first universal joint (5), a second one of the universal joints (6, 13, 17), is located near the second universal joint (11), and a third one of the universal joints (6, 13, 17) is located near or directly against the track-forming unit (1).

8. A ski-track forming apparatus according to claim 1, with the distinction that the arm (3), in the zone of its end joined with the track-forming unit, is provided with a universal joint (16), which can be fixed in place with axis (X3) extending in horizontal and transverse directions relative to its longitudinal direction.

9. A ski-track forming apparatus according to claim 1, with the distinction that the arm (3), in the zone of its end connected with the track-forming unit (1) is provided with a universal joint (19), with an axis (X4) extending approximately in the track direction, at least during the track forming.

10. A ski-track forming apparatus according to claim 1, with the distinction that the arm (3), preferably at a distance from the track-forming unit (1) which corresponds to about one-third of its total length, is provided with a universal joint (11) with an axis (X6) having a vertical component, at least during track forming, for connecting an end portion of the arm to which the track forming unit is fastened, to the remaining portion of the arm for pivotal movement of said end portion about said vertical component of the axis (X6) of said universal joint.

11. A ski-track forming apparatus according to claim 1, with the distinction that the arm (3) is provided with three hydraulically operable universal joints (6, 13, 17), with axes (X2, X5, X7), in each case, extending in horizontal and transverse direction relative to its longitudinal direction.

12. A ski-track forming apparatus for attachment to a track-laying vehicle, said apparatus including:

a track forming unit comprising two parallel track-forming tools extending in a track direction;

arm means connected at one end thereof to said track-forming unit for attaching said track-forming unit to the track-laying vehicle; and support means connectable to the rear end portion of the track-laying vehicle for supporting said arm means on the track laying vehicle;

said support means comprising at least one guide rod having a horizontal axis extending transverse to the longitudinal extent of the track-laying vehicle, and said arm means comprising an end section at the other end thereof movable along said horizontal axis of said guide rod for moving said track-forming unit in a horizontal plane in a direction transverse to the track direction.

13. A ski-track forming apparatus according to claim 12 wherein said arm means comprises a second section and a first universal joint for pivotally connecting said second section with said end section for lateral movement of said second section relative to said first section.

14. A ski-track forming apparatus according to claim 13 further comprising means for retaining said first universal joint in a predetermined position thereof.

15. A ski-track forming apparatus according to claim 13 wherein said arm means comprises a third section the length of which is about one third of the total length of said arm means, and a second universal joint for pivotally connecting said third section with said second section for lateral movement of said third section relative to said second section.

16. A ski-track forming apparatus according to claim 12 comprising two guide rods extending parallel to each other and drive means for moving said end section of said arm means along said two guide rods, said end section of said arm means having an end portion having first and second openings through which said two guide rods respectively extend, and a third threaded opening, and said drive means comprises a threaded spindle extending through said third threaded opening and a motor for rotating said threaded spindle to thereby effect displacement of said end section along said two guide rods.

17. A ski-track forming apparatus according to claim 15 wherein said arm means comprises two universal joints each having a horizontal axis extending transverse to the track direction for supporting said second and third sections for pivotal movement relative to said end and second sections, respectively, in vertical planes, and two hydraulically operable means for pivoting each of said second and third sections relative to a respective one of said end and second sections about a respective horizontal axis of a respective one of the two universal joints.

18. A ski-track forming apparatus according to claim 17 wherein one of said two universal joints is located near said first universal joint and a second one of said two universal joints is located near said second universal joint.

19. A ski-track forming apparatus according to claim 12 wherein said arm means comprises a universal joint having a horizontal axis extending transverse to the track direction for connecting said track forming unit with said arm means for pivotal movement relative thereto in a vertical plane.

20. A ski-track forming apparatus according to claim 12 wherein said arm means comprises a universal joint having a horizontal axis extending in the track direction at least during formation of the track, for connecting said track forming unit to said arm means for tilting movement about the axis of said universal joint.

* * * * *